US007284503B2

(12) United States Patent
Elmberg

(10) Patent No.: US 7,284,503 B2
(45) Date of Patent: Oct. 23, 2007

(54) CHILD HARNESS

(75) Inventor: Lisen Elmberg, Stockholm (SE)

(73) Assignee: Baby Bjorn AB, Danderyd (SE)

( * ) Notice: Subject to any disclaimer, the term of this patent is extended or adjusted under 35 U.S.C. 154(b) by 101 days.

(21) Appl. No.: 10/534,505

(22) PCT Filed: Nov. 13, 2003

(86) PCT No.: PCT/SE03/01757

§ 371 (c)(1),
(2), (4) Date: May 11, 2005

(87) PCT Pub. No.: WO2004/049875

PCT Pub. Date: Jun. 17, 2004

(65) Prior Publication Data

US 2006/0048722 A1 Mar. 9, 2006

(30) Foreign Application Priority Data

Nov. 29, 2002 (SE) ..... 0203532

(51) Int. Cl.
*A47D 13/02* (2006.01)

(52) U.S. Cl. ..... 119/770; 224/160

(58) Field of Classification Search ..... 119/770, 119/792; 224/160, 161, 157, 158, 159; 2/44; 182/3; 128/875; 280/288.4, 290; 297/275, 297/464, 468; D3/213, 214
See application file for complete search history.

(56) References Cited

U.S. PATENT DOCUMENTS 3,575,326 A * 4/1971 Chappell ..... 224/159
3,799,414 A 3/1974 Fiffer
4,149,687 A * 4/1979 Nunemacher ..... 224/159
4,434,920 A * 3/1984 Moore ..... 224/160
4,458,834 A * 7/1984 Rosen ..... 224/160
4,492,326 A * 1/1985 Storm ..... 224/160
4,724,988 A * 2/1988 Tucker ..... 224/160
4,911,426 A * 3/1990 Scales ..... 482/69
4,944,057 A * 7/1990 Shaw ..... 5/89.1
5,205,451 A * 4/1993 Manzer ..... 224/161
5,208,925 A * 5/1993 Edlund ..... 5/424
5,246,152 A * 9/1993 Dotseth ..... 224/159
5,690,258 A * 11/1997 Kataoka ..... 224/160
5,692,655 A * 12/1997 Fair et al. ..... 224/160
5,732,861 A * 3/1998 Jakobson ..... 224/160

(Continued)

FOREIGN PATENT DOCUMENTS

GB 2 028 633 A 3/1980

(Continued)

*Primary Examiner*—Yvonne R. Abbott
(74) *Attorney, Agent, or Firm*—Jacobson Holman PLLC

(57) ABSTRACT

A child harness has a child carrying pouch that is a generally flexible piece of material with side edges which define at least a part of a respective leg opening in the lower part of the pouch. The piece of material includes an elastically flexible sheet that is enclosed in a fabric casing, with a first piece of fabric on one major surface of the sheet and a second piece of fabric on the other major surface of the sheet. The pieces of fabric are sewn together to provide a seam. The seam is placed on the one major surface of the piece of material in the region of a respective leg opening at a distance of at least 0.5 cm from the edge of the leg opening.

8 Claims, 2 Drawing Sheets

U.S. PATENT DOCUMENTS

D395,161 S * 6/1998 Fair et al. ..... D3/214
5,848,741 A * 12/1998 Fair ..... 224/160
5,950,887 A * 9/1999 Powell ..... 224/158
D437,996 S * 2/2001 Fair et al. ..... D3/214
6,182,873 B1 * 2/2001 Christopher et al. ..... 224/159
6,318,608 B1 * 11/2001 Fowler et al. ..... 224/161
6,409,060 B2 * 6/2002 Donine ..... 224/160
6,598,771 B2 * 7/2003 Norman ..... 224/160
6,637,377 B2 * 10/2003 Lobanoff et al. ..... 119/792
D484,685 S * 1/2004 Kassai et al. ..... D3/213
6,736,299 B2 * 5/2004 Bergkvist ..... 224/160

FOREIGN PATENT DOCUMENTS

WO WO 92/16130 10/1992

* cited by examiner

CHILD HARNESS

BACKGROUND OF THE INVENTION

1. Field of Invention

The present invention relates to a child harness having a child carrying pouch and a harness for supporting the pouch.

The invention thus relates to a harness that includes a child carrying pouch which comprises a generally flexible piece of material that has side edges which define at least a part of a respective leg opening in the lower part of the pouch, wherein said piece of material includes an elastically flexible sheet that is encased in a fabric casing that comprises a first fabric on one major surface of the sheet and a second fabric on the other major surface of the sheet, and wherein said fabric layers are sewn together to provide a seam.

2. Description of the Prior Art

When evaluating the comfort afforded to a child by the child carrying pouch of this kind of harness, it was found that the edge of the leg opening is liable to pinch around at least part of the child's leg, particularly around its thigh. This pinching, or squeezing, effect has, in some instances, given rise to the suspicion that the blood circulation in the child's leg has been impaired.

This pinching effect may, of course, be referred generally to the fact that a major part of the load exerted by the child, i.e. its weight, is transferred to the bottom part of the pouch in the vicinity of the edge of the leg opening. However, a closer investigation into the reasons for the effects observed has shown that whilst the two fabrics are able to stretch satisfactorily and whilst the flexibility of the sheet was found to be satisfactory, it was also found that the seams between the fabric layers were located along the edge of the sheet, that is to say at half the thickness of the piece of material. We also found that the seams themselves were relatively hard and rigid with regard to their ability to stretch lengthwise. In combination with the location of the seams, the seams will therefor be pressed against and around part of the child's thigh when the child is seated normally in the pouch, with its stomach or back facing towards the piece of material.

The object of the invention is to provide a favorable solution to this problem in a technically simple and readily achievable manner.

SUMMARY OF THE INVENTION

This object is achieved either partly or completely by means of the present invention.

According to an embodiment of the present invention, a child harness includes a child carrying pouch with a generally flexible piece of material with side edges that define at least a part of a respective leg opening in a lower part of the pouch. The piece of material includes an elastically flexible sheet that is enclosed in a fabric casing that has a first piece of fabric on one major surface of the sheet and a second piece of fabric on another major surface of the sheet. The pieces of fabric are sewn together to provide a seam placed on the one major surface of the piece of material in the region of the respective leg opening. The seam is located at a distance of at least 0.5 cm from the edge of the leg opening.

Further embodiments of the invention will be apparent from the accompanying detailed description.

As a result of identifying the problem and its technical cause, it was possible to provide a favorable solution to the problem, either in part or in total, both from a technical and from a production aspect.

The invention is based on the concept of moving the seam on one main surface of the piece of material away from the edge of said piece to a position that is considerably distanced from the edge region of respective leg openings. The seam will preferably be located about 2 cm from the edge of said piece of material, so as provide an adequate margin that will ensure that the circumferential region of the child's leg that comes into contact with the edge of the leg opening will not be in contact with the seam.

Since the piece of material has a generally strip-like lower end portion that can be displaced longitudinally and received in an associated fitting, the seams may, of course, extend parallel with the side edges of the strip-like portion on one main surface of said part so that the seam will be distanced from the edge of its leg opening. The seams may, of course, approach the edge of the piece of material at a distance from those parts of the side edges of said piece of material that define leg openings.

The invention will now be described in more detail by way of example with reference to the accompanying drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
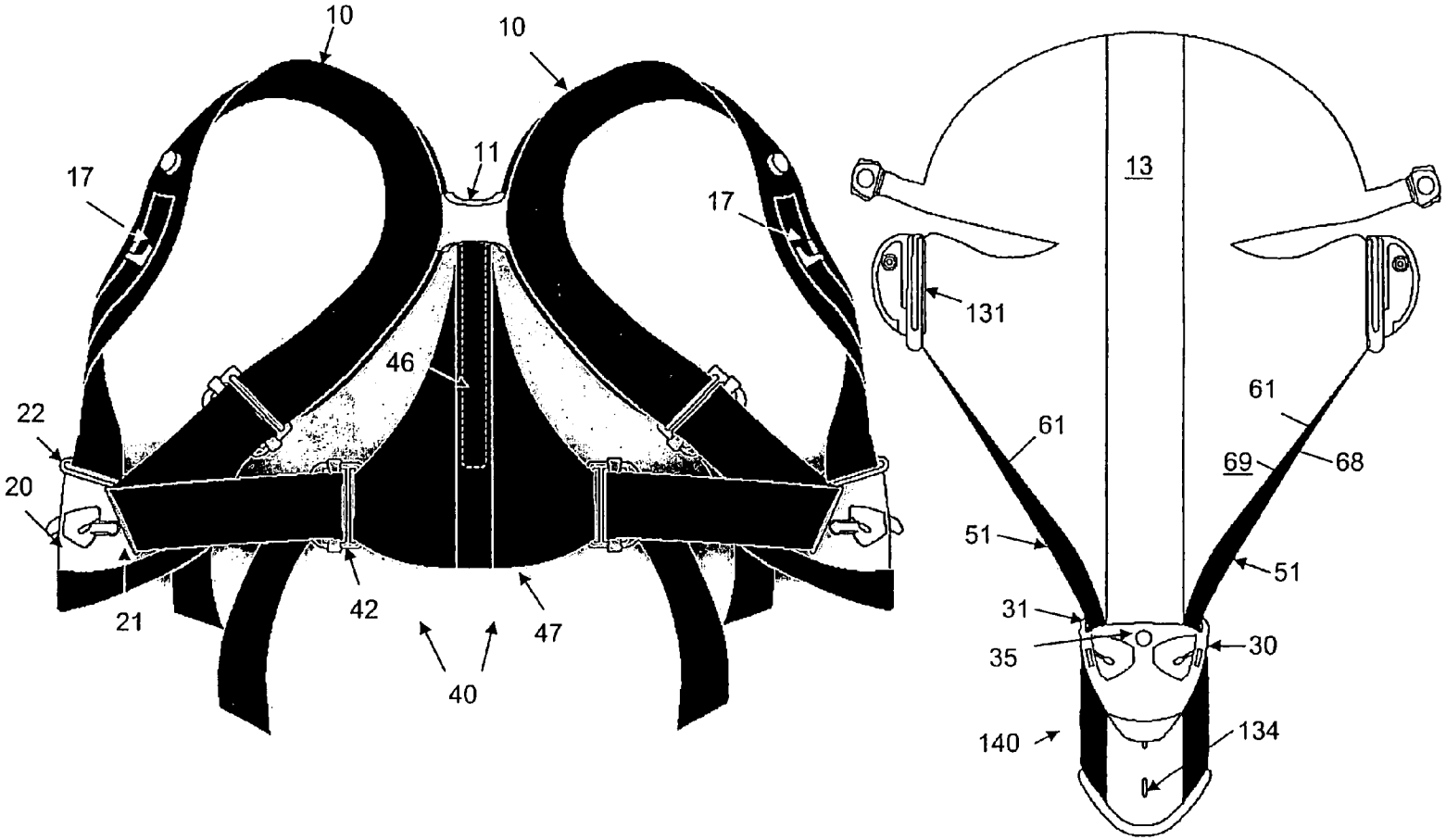
FIG. 1 is a schematic view of a child's harness as seen from the rear side of the harness, and also shows the inside of a piece of material that can be coupled to the harness to form a baby carrying pouch on the front side of the harness, that is to say on the chest side of the wearer.

FIG. 1 shows the inside of a front piece 13 which, together with a harness 40, forms a baby carrying pouch 130 (FIG. 2) on the front side of the harness 40. The front piece 13 is thus intended to be supported by the harness 40, which includes two looped shoulder straps 10 that are mutually coupled by means of a fitting 11 on the rear side of the harness and a triangular back piece 47 which is made of flexible material and which includes a vertically extending springy and bendable stiffening 46. The loops 10 carry at their lower parts situated on the front side of the wearer a coupling element 20 which includes at its upper end an attachment 22 for one end of an associated strap loop and which has on one side thereof a fitting 21 that includes a transit opening for the other end part of said loop, this other end part extending to a length adjustment fitting 42 connected to the back piece 47. Respective elements 20 can thus be considered to form on the front side of the harness the end portions of a waist belt that includes horizontal harness parts that connect between the two elements 20.

The front piece 13 has a lower strip-like part 140 that can move lengthwise through a transit loop or eyelet 31 on an anchoring element 30. The anchoring element 30 carries a forwardly projecting pin 35, which may have an enlarged head and which can be anchored in a corresponding press stud fitting (or buttonhole) 131 in a row 134 of such elements (buttonholes) that extends along the central part of the strip-like part 140, with the intention of preventing movement of said part 140 relative to the anchoring element. The effective length of the strip-like part 140 determines the length of the front piece 13 in a vertical direction and thus also the depth of the pouch 130.

The elements 20 can be connected releasably to respective sides of the elements 30. The front piece 13 has at respective upper side portions a coupling element 131 for releasable connection with a corresponding coupling element 17 on the strap loop 10 on the front side of the harness. Each loop 10 may include a length adjustment fitting 42 for changing the size of the loop. The length of the waist strap can be changed with the aid of the adjustment fitting 42.

FIG. 1 shows the inside of the rear side of the harness (said rear side being intended to be placed on the rear side of the wearer) and also shows the front piece 13, which is intended to be carried on the front side of the harness (i.e. on the chest side of the wearer).

The front piece 13 can be considered to be formed by a generally flat piece of material that includes a flexible and springy, elastic sheet of plastic foam, where a first major surface of said sheet forms the inside of the front piece 13. The inside of the front piece 13 carries a first fabric 69 while the opposite major surface carries a second fabric 68. These pieces of fabric are joined together by a seam 61.

Figure 2:
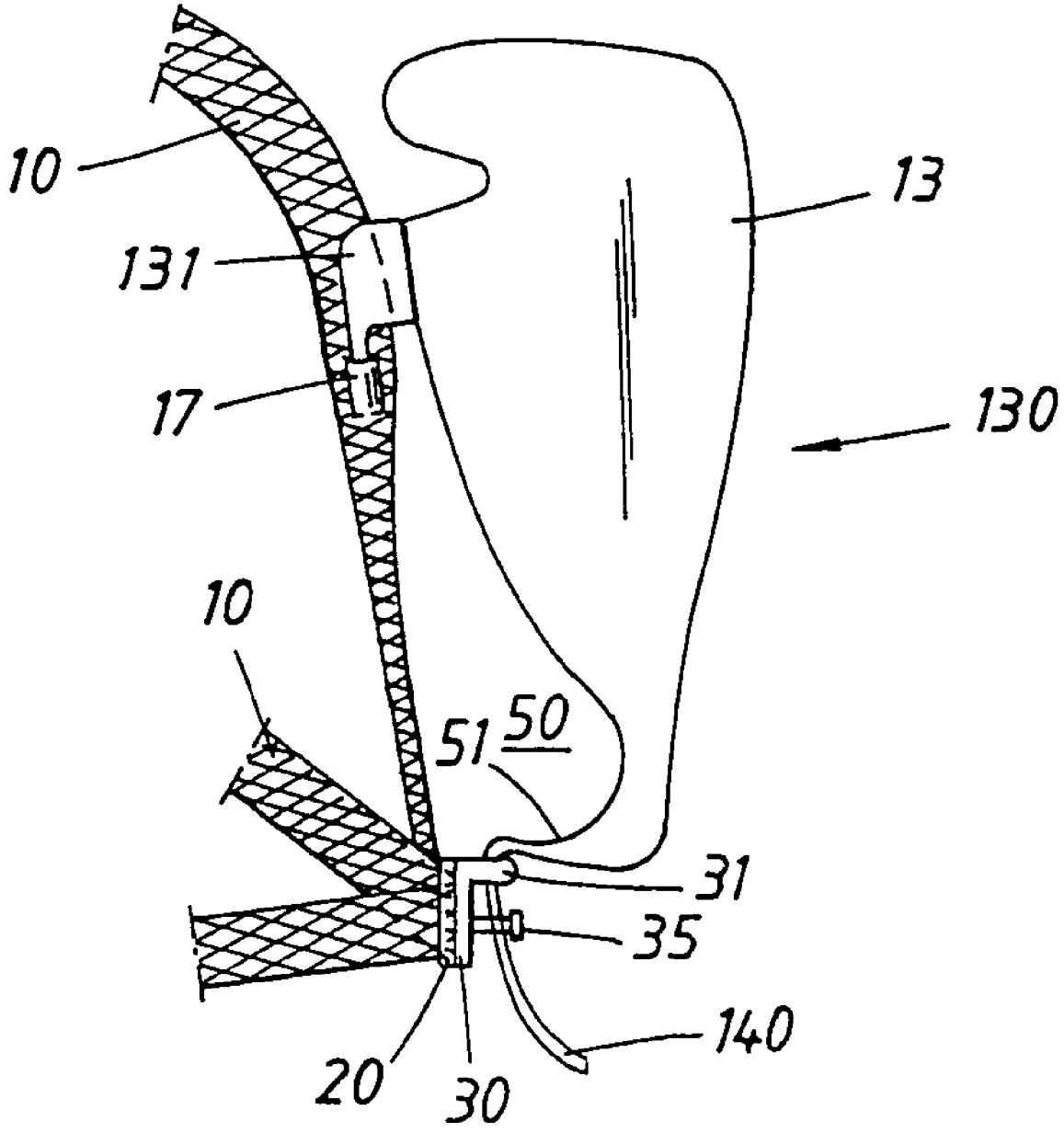
FIG. 2 is a schematic side view of a baby carrying pouch formed by the front piece and an adjacent part of the harness.

The seam 61 extends at a distance from the edge of the front piece 13 that defines the edge 51 of a leg opening 50 in the pouch 130 (FIG. 2). The distance between the seam 61 and said edge 51 is roughly 2 cm and the seam also extends at this distance from the edge 51 along both edge portions of the strip-like part 140. The seam 61 may extend out towards the edge part of the front piece 13, at the upper parts of said front piece 13.

As will be understood, the seam 61 may be situated on the opposite major surface of the front piece 13 at a corresponding distance from the edge of said piece of material that defines the edge 51 of the leg opening 50 of the pouch 130, particularly in the longitudinal part of said material.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A child harness comprising a child carrying pouch with a substantially flexible piece of material that has side edges which define at least a part of a respective leg opening in a lower part of the pouch, the piece of material including an elastically flexible sheet that is enclosed in a fabric casing that has a first piece of fabric on one major surface of the sheet and a second piece of fabric on another major surface of the sheet, the pieces of fabric being sewn together to provide a seam placed on the one major surface of said piece of material in a region of the respective leg opening at a distance of at least 0.5 cm from an edge of said leg opening.

2. A child harness according to claim 1, wherein the seam is located at a distance of at least 1 cm from the edge of said leg opening.

3. A child harness according to claim 1, wherein the piece of material includes in its lower part a central strip-like portion which can be displaced longitudinally and received in a coupling element on a front side of the harness; and upper laterally situated edge parts of said piece of material that are releasably connected to adjacent parts of the harness that are carried on the front side of a wearer, wherein the seam extends at a distance from the edge of said piece of material along the strip-like part.

4. A child harness comprising:

a child carrying pouch with a substantially flexible piece of material that has side edges which define at least a part of a respective leg opening in a lower part of the pouch, the piece of material including an elastically flexible sheet that is enclosed in a fabric casing that has a first piece of fabric on one major surface of the sheet and a second piece of fabric on another major surface of the sheet, the pieces of fabric being sewn together to provide a seam placed on the one major surface of the piece of material in a region of the respective leg opening;

the piece of material having in the lower part of the pouch a central strip which can be displaced longitudinally and received in a coupling element on a front side of the harness, and upper laterally situated edge parts that are releasably connected to adjacent parts of the harness carried on the front side of a wearer; and the seam being located at least 0.5 cm from an edge of the leg opening and extending along the central strip at a distance from the edge of the piece of material.

5. A child harness comprising:

a child carrying pouch with side edges in a lower part thereof that define at least a part of a respective leg opening;

the pouch including an elastically flexible sheet enclosed in a fabric casing with a first piece of fabric on an interior surface of the pouch and a second piece of fabric on an exterior surface of the pouch; and the first and second pieces of fabric being joined together by a seam located on the exterior surface of the pouch in a region of the respective leg opening at a distance of at least 0.5 cm from the side edge of the pouch.

6. The child harness according to claim 5, wherein the seam is located on the exterior surface of the pouch in a region of the respective leg opening at a distance of at least 2 cm from the side edge of the pouch.

7. The child harness according to claim 5, further comprising a harness for wear by a user, the harness capable of being releasably coupled to the pouch by a pair of harness upper couples and a pair of harness lower couples; and wherein the pouch includes a pair of upper laterally located edge parts that releasably couple to the harness upper couples, and the lower part of the pouch includes a central strip with an anchor centrally located between each side edge of the strip, the strip capable of being displaced longitudinally and the anchor releasably coupling to the pair of harness lower couples.

8. The child harness according to claim 7, wherein each pouch seam continues on the central strip at a distance of from 0.5 cm to 2 cm from the side edges of the strip.

* * * * *